US005358109A

United States Patent [19]

Nichols

[11] Patent Number: 5,358,109

[45] Date of Patent: Oct. 25, 1994

[54] GOLF BAG

[76] Inventor: James Nichols, Nicholsdeon Productions, Inc., 30 Greenwich Ave. #1A, New York, N.Y. 10011

[21] Appl. No.: 119,490

[22] Filed: Sep. 13, 1993

[51] Int. Cl.[5] ..... A63B 55/00; A63B 55/06; A63B 55/08

[52] U.S. Cl. ..... 206/315.3; 206/315.5; 206/315.6; 206/315.7; 248/96

[58] Field of Search ..... 206/315.2–315.7; 280/DIG. 5, DIG. 6; 211/70.2; 248/96; 224/274, 901

[56] References Cited

U.S. PATENT DOCUMENTS

| | | | |
|---|---|---|---|
| 1,092,729 | 4/1914 | Low et al. | 206/315.6 X |
| 2,007,709 | 7/1935 | Eppens | 206/315.3 X |
| 2,256,521 | 9/1941 | Kirkpatrick et al. | 206/315.3 |
| 2,471,169 | 5/1949 | Salzberg et al. | 206/315.4 |
| 2,837,346 | 6/1958 | Chambless | 206/315.4 X |
| 3,530,919 | 9/1970 | May | 206/315.5 X |
| 3,674,072 | 7/1972 | Shuto | 206/315.5 X |
| 4,703,851 | 11/1987 | Stewart | 206/315.8 X |
| 4,881,638 | 11/1989 | Cho | 206/315.3 |
| 4,898,352 | 2/1990 | Hoffman | 206/315.7 X |
| 4,911,292 | 3/1990 | Airey, Jr. | 206/315.4 X |

FOREIGN PATENT DOCUMENTS

| | | | |
|---|---|---|---|
| 9204 | 7/1933 | Australia | 206/315.4 |
| 216273 | 10/1955 | Australia | 206/315.3 |
| 438519 | 5/1912 | France | 206/315.3 |
| 9101029 | 6/1991 | PCT Int'l Appl. . | |
| 486831 | 6/1938 | United Kingdom . | |
| 2234912 | 2/1991 | United Kingdom | 206/315.3 |

*Primary Examiner*—Sue A. Weaver
*Attorney, Agent, or Firm*—Thomas L. Adams

[57] ABSTRACT

A golf bag has a main bag and an auxiliary bag. The main bag has an upper opening and is sized to hold golf clubs. This main bag has a lower end with an upwardly open pocket. The auxiliary bag has an upper mouth and is sized to hold golf clubs. This auxiliary bag is sized to fit into the pocket and lie alongside the main bag.

24 Claims, 6 Drawing Sheets

FIG. 14
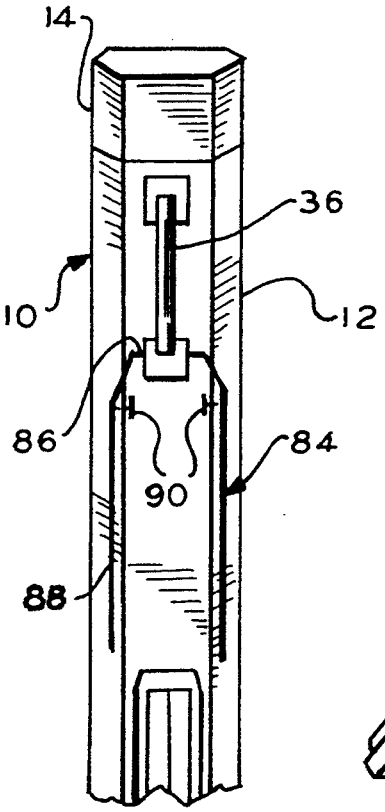
FIG. 16
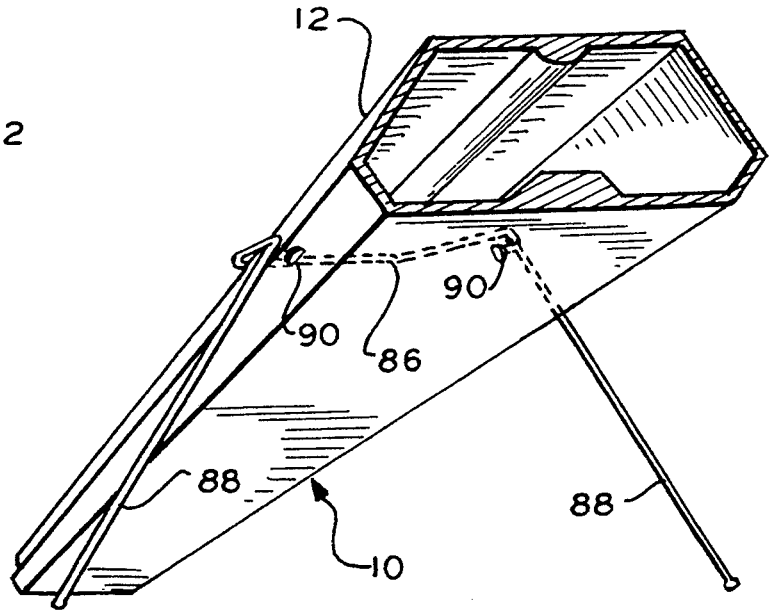
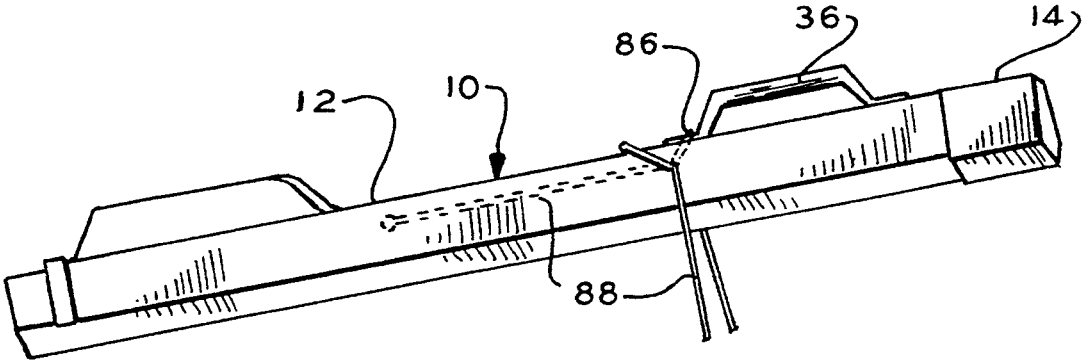
FIG. 15

GOLF BAG

BACKGROUND OF THE INVENTION

1. Field of the Invention

The present invention relates to golf bags, and in particular, to a golf bag composed of an auxiliary bag that attaches to a main bag.

2. Description of Related Art

When approaching a green, golfers normally remove from their golf bag a number of approach clubs, e.g., a putter, nine iron, pitching wedge and sand wedge. Carrying so many clubs can be cumbersome. Additionally, clubs can be lost when so many loose clubs are being handled at once.

PCT application WO91/18650 shows a two part golf bag held together by clips. A disadvantage with this type of split bag is the difficulty in detaching and using one bag. Typically, a golf bag will be strapped to the back of a golf cart, either motorized or hand drawn. This strap would normally encircle both parts of the bag. Thus every time one wishes to remove one bag, the strap must be undone for the green play and then redone when the cart must be moved. This operation is in addition to the releasing and then redoing of the fasteners that hold the two parts of the golf bag together.

British specification 486,831 shows another two part golf bag joined together by hooks and a clamp. This golf bag has similar disadvantages. See also U.S. Pat. No. 2,837,346 and French Patent 438,519.

Accordingly, there is a need for a two part golf bag where one part can be secured to a golf cart while the other part can be easily removed.

SUMMARY OF THE INVENTION

In accordance with the illustrative embodiments, demonstrating features and advantages of the present invention, there is provided a golf bag having a main bag and an auxiliary bag. The main bag has an upper opening and is sized to hold golf clubs. This main bag has a lower end with an upwardly open pocket. The auxiliary bag has an upper mouth and is sized to hold golf clubs. This auxiliary bag is sized to fit into the pocket and lie alongside the main bag.

By employing such apparatus a relatively effective and simple golf bag is achieved to allow convenient carrying of approach clubs to a green. In a preferred embodiment, a smaller auxiliary bag fits inside a pocket formed in the base of the main bag. This pocket may underlie a tall concave region bordered by ribs that cradle the auxiliary bag. The pocket provides a simple support for the auxiliary bag without the need for more complicated, heavy duty fasteners. With such a pocket, the auxiliary bag can be kept adequately secure by such simple holding means as a hook, a Velcro pad, a magnet, a snap belt, etc. This holding means keeps the upper part of the auxiliary bag against the main bag during normal play, as opposed to when the bag is being carried off the cart before or after play.

The bag can have in addition to the above mentioned holding means, another securing means such as a strap and buckle attached to the main bag. Thus, the auxiliary bag can be secured for transportation by buckling the strap around the auxiliary bag.

This strap can have moreover, a second function. The strap can be designed to attach the main bag to the golf cart independently of the auxiliary bag. Thus, this strap and buckle can be undone and pulled back to attach to a belt and buckle normally found on a golf cart. By securing the main bag in this fashion, the region designed to hold the auxiliary bag is free. Thus the auxiliary bag can be repeatedly loaded and removed from the pocket in the main bag without dealing with the transport strap.

Preferably the auxiliary bag has a boot that is keyed to the pocket in the main bag so the auxiliary bag can be inserted in one preferred position. The boot may have an overhanging portion that allows the boot to be inserted into the pocket up to a predetermined depth. Also, the preferred auxiliary bag may have a pair of pivoting legs that can be deployed to hold the auxiliary bag in a semi-erect position.

BRIEF DESCRIPTION OF THE DRAWINGS

The above brief description, as well as other objects, features and advantages of the present invention will be more fully appreciated by reference to the following detailed description of presently preferred, but nonetheless illustrative embodiments in accordance with the present invention, when taken in conjunction with the accompanying drawings, wherein:

FIG. 14 is an elevational view of the outer side of the auxiliary bag of FIG. 1, modified to include a leg assembly;

FIG. 15 is a side view of the bag of FIG. 14 with its leg assembly deployed to hold the auxiliary bag in a semi-erect position; and FIG. 16 is an axonometric view of the auxiliary bag of FIG. 15, with its upper portion removed for illustrative purposes.

DETAILED DESCRIPTION OF THE PREFERRED EMBODIMENT

Figure 1:
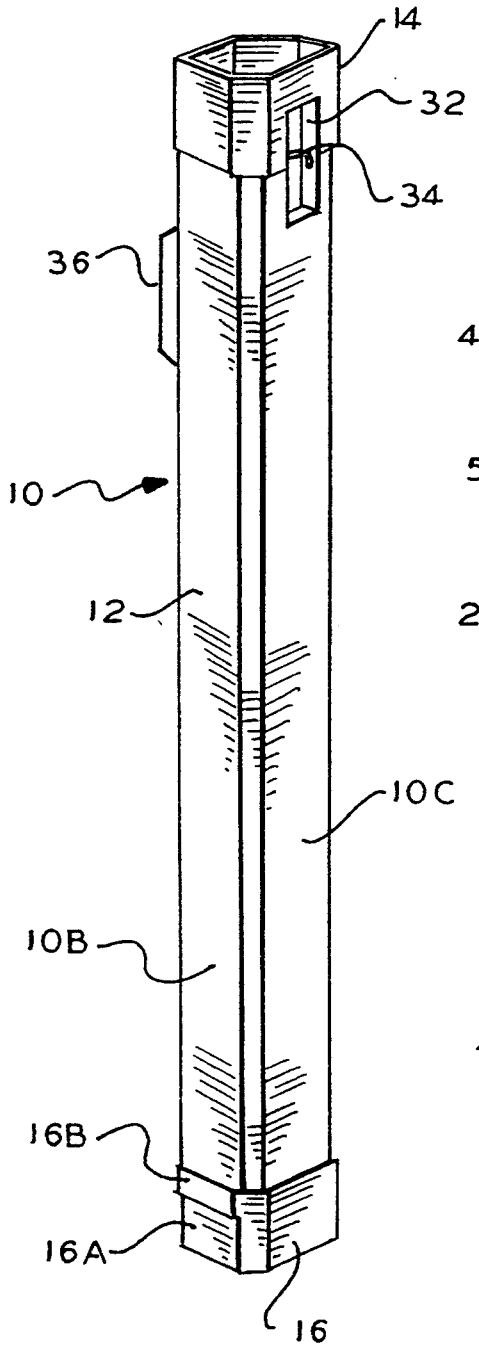
FIG. 1 is an axonometric view of an auxiliary bag in accordance with the principles of the present invention.
Figure 2:
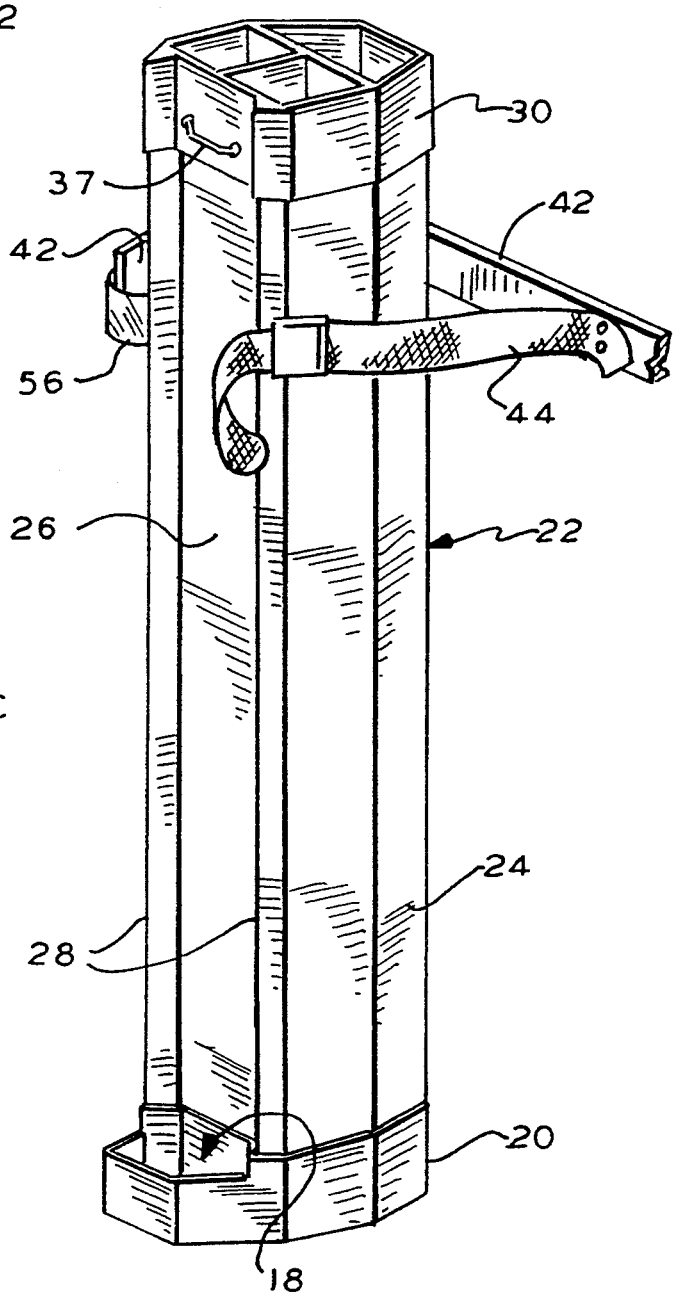
FIG. 2 is an axonometric view of a main bag that together with the auxiliary bag of FIG. 1 form a golf bag in accordance with the principles of the present invention.
Figure 3:
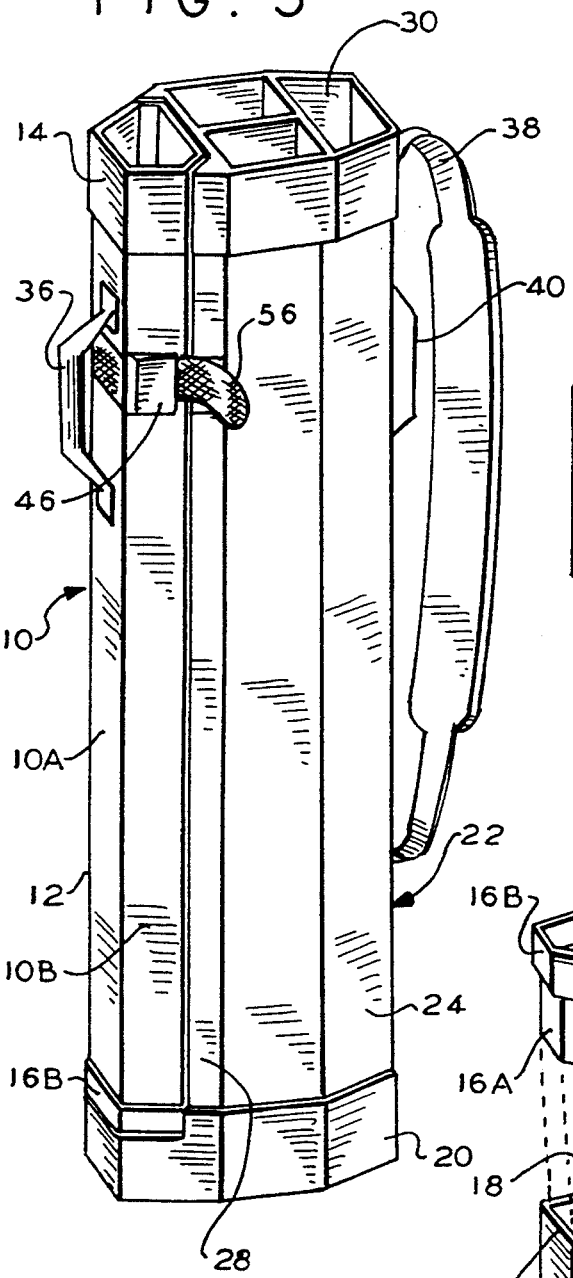
FIG. 3 is an axonometric view of the main and auxiliary bag of FIGS. 1 and 2, assembled together for transport.

Referring to FIGS. 1-3, auxiliary bag 10 has a six-sided sleeve 12 that can be formed of leather, plastic or other appropriate materials, including a cloth tube reinforced with supporting struts. Side faces 10B form an angle of about 120 degrees with the outside face 10A of auxiliary bag 10. Outside face 10A is parallel to rear face 10C. The outer face 10A of auxiliary bag 10 has a handle 36.

The upper part of auxiliary bag 10 has a reinforcing collar 14. The bottom of auxiliary bag 10 has a cup-shaped boot 16. Boot 16 has a bottom portion 16A under an overhanging portion 16B. Bottom portion 16A is sized and keyed to fit into pocket 18. Pocket 18 is a receptacle formed in base 20 of main bag 22.

Main bag 22 has a main sleeve 24 whose perimeter is almost octagonal except for an auxiliary region 26, which forms a concavity 26 bordered by ribs 28. The upper end of main sleeve 24 is capped by a reinforcing collar 30 shown with partitions to allow segregation of golf clubs placed within the bag.

A shoulder strap 38 is attached to the main bag 22 opposite region 26. Underlying shoulder strap 38 is a handle 40, also mounted on main bag 22.

Mounted in a lateral upper recess 32 of auxiliary bag 12 is a hook 34, which is part of a holding means. Another part of the holding means is eye 37 shown in FIG. 2 as a U-shaped bracket riveted to reinforcing collar 30 between the ribs 28 in the auxiliary region 26.

In FIG. 2, main bag 22 is shown leaning against a support bracket 42, which is part of a golf cart (either powered or hand drawn). Bracket 42 has a bag belt 44 designed to attach to a bag buckle (shown hereinafter) on the outer end of bracket 42.

Figure 4:
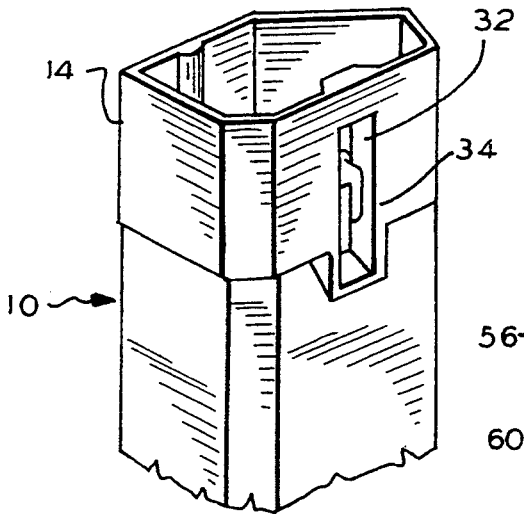
FIG. 4 is a detailed axonometric view of the upper portion of the auxiliary bag of FIG. 1.
Figure 5:
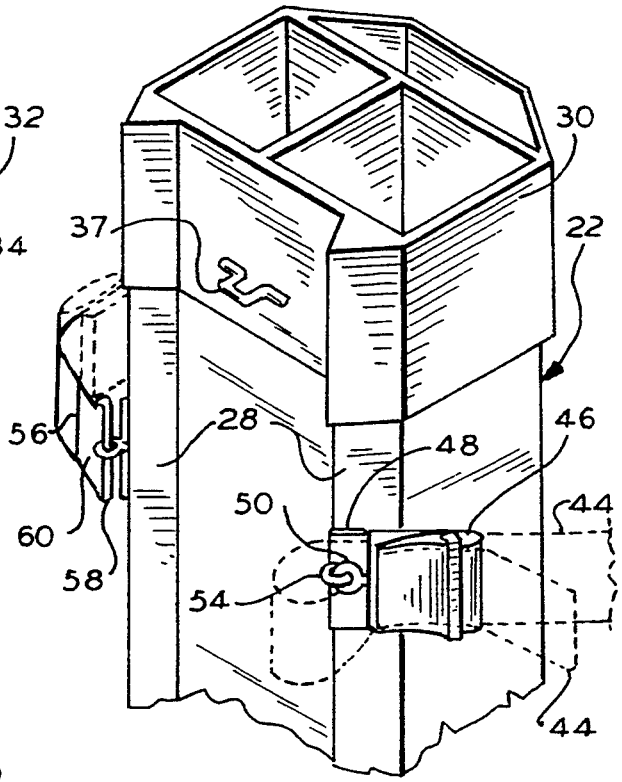
FIG. 5 is a detailed, axonometric view of the upper portion of the main bag of FIG. 2.
Figure 9:
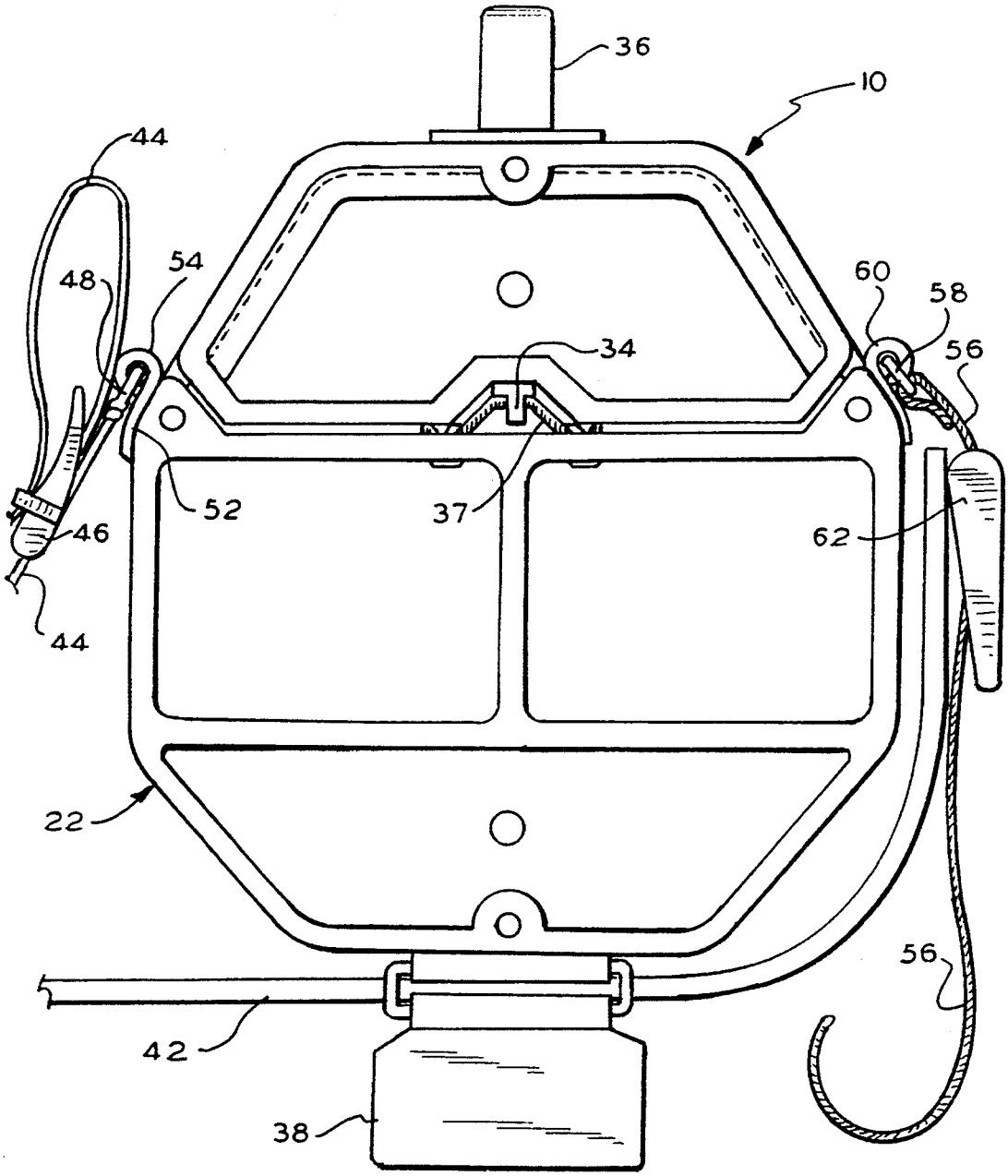
FIG. 9 is a top view of the bag of FIG. 3.

Referring to FIGS. 4, 5 and 9, main bag 22 is shown having a main buckle 46, shown with a tab 48 reinforced with a grommet 50. Grommet 50 is held in eye 54, which is riveted to the side of main bag 22. A swivel joint 52 allows buckle 46 to roll 180° around a horizontal axis. Buckle 46 is shown swung back to receive bag belt 44 from bracket 42 of the golf cart.

Opposite buckle 46 is a main strap 56 looped through a steel ring 58. Ring 58 fits through an eye 60, riveted to the outside of main bag 22. Main strap 56 is shown passing through bag buckle 62 mounted on the golf cart bracket 42. Accordingly, by tightening strap 56 and belt 44, main bag 22 can be secured to bracket 42 of the golf cart.

The positions of strap 56 and buckle 46 can be exchanged when the buckle and belt on the golf cart are the reverse of that illustrated. Such reversal normally exists between the right and left side of a motorized golf cart. The exchange of strap 56 and buckle 46 can be accomplished by undoing eyes 54 and 60 (or by undoing elements 50 and 58). For example eyes 54 and 60 may be hollow split rings, each containing a slider that moves to close and open the split. Alternatively, the eyes may be solid split rings, each having a sleeve that slides to close and open the split. Still other embodiments may employ a ring having a hinged segment that swings open and closed.

Referring again to FIG. 3, auxiliary bag 10 is shown mounted against main bag 22. Previously mentioned main strap 56 is now shown wrapped across the auxiliary bag 10 underneath handle 36. The end of strap 56 is shown fastened in main buckle 46. Buckle 46 has for this reason been swung toward auxiliary bag 10.

Figure 7:
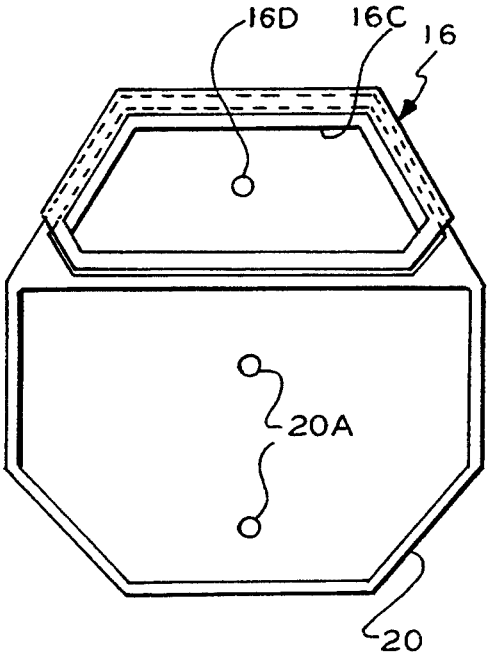
FIG. 7 is a top plan view of the base and boot of FIG. 6.
Figure 6:
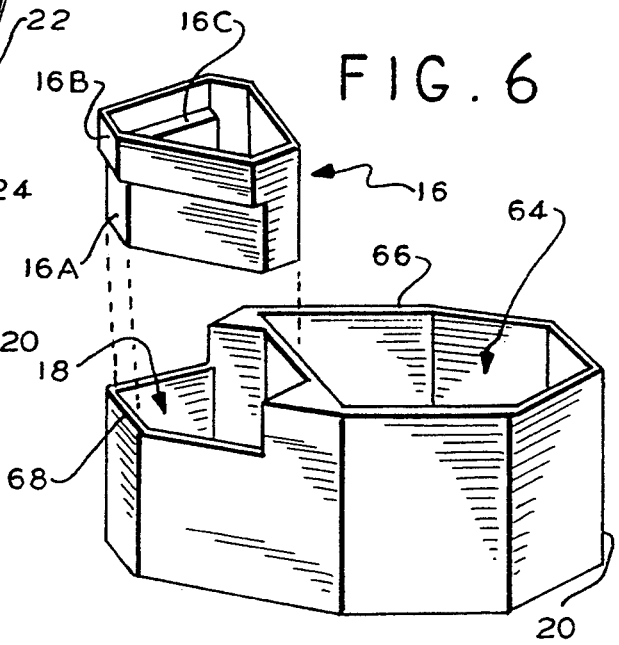
FIG. 6 is a detailed view of the boot and base of the auxiliary and main bags of FIG. 3.
Figure 8:
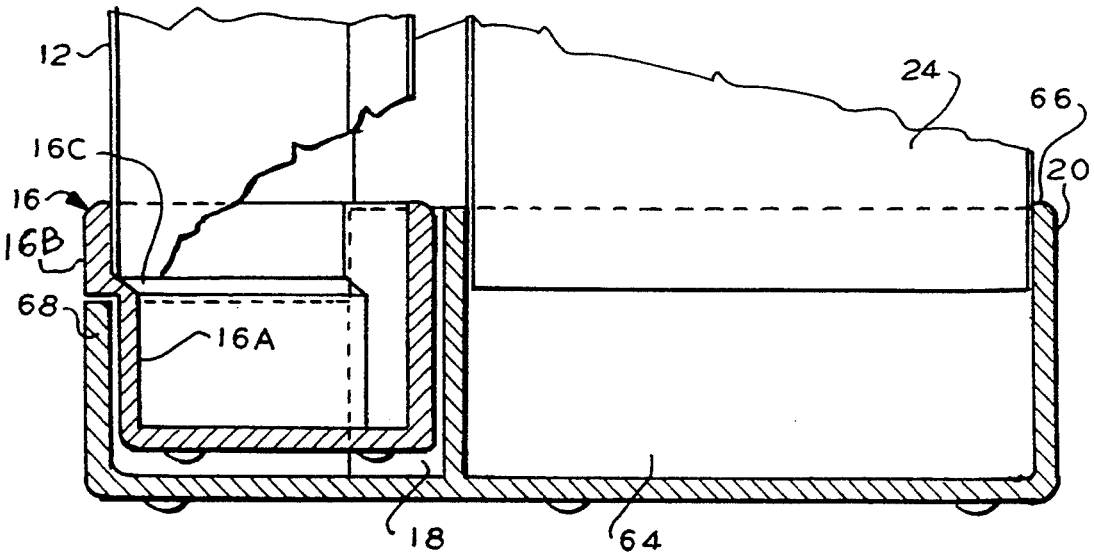
FIG. 8 is an elevational, cross-sectional view of the bottom portion of the bag of FIG. 3.

Referring to FIGS. 6, 7 and 8, previously illustrated main base 20 is shown having an approximately octagonal footprint. A main receptacle 64 in base 20 is encircled by a main rim 66 having six sides, two pairs of them being parallel. Pocket 18 (also referred to as an auxiliary receptacle) is encircled by an auxiliary rim portion 68. The rim portion 68 is at a lower elevation than main rim 66. Auxiliary boot 16 is shown as a cup-shaped member, namely a hollow polygonal prism. The overhanging portion 16B has a larger perimeter and therefore connects to lower portion 16A by means of a transition, shown as a shelf 16C. Base 20 has a number of drain holes 20A for draining. Similarly, boot 16 has a hole 16D for draining as well.

FIG. 8 shows auxiliary sleeve 12 inserted into the overhanging portion 16B of boot 16 to abut the shelf 16C. Also, main sleeve 24 is shown inserted into the main receptacle 64 of base 20.

To facilitate an understanding of the principles associated with the foregoing apparatus, its operation will be briefly described. The golfer may arrive carrying the golf bag assembled as shown in FIG. 3, using the shoulder strap 38. Clubs such as the putter, nine iron, sand wedge and chipping wedge may be placed in auxiliary bag 10. The other clubs and accessories may be placed in the various compartments in main bag 22.

When the bag is placed in a golf cart, strap 56 may be undone from buckle 46. The auxiliary bag 10 will not release immediately from main bag 22 since hook 34 is still captured in eye 37. The bag may next be arranged as shown in FIG. 9. Specifically, the shoulder strap 38 can be placed around the bracket 42. Then the main buckle 46 can be rolled around a horizontal axis and swung backwards to the position shown in FIG. 9. In this position, bag belt 44 can be inserted through the main buckle 46 as shown. At the same time, strap 56 can be inserted through the bag buckle 62 on golf cart bracket 42. Strap 56 and belt 44 can then be tightened to secure the golf bag against bracket 42.

At this time, strap 56 no longer restrains auxiliary bag 10. Accordingly, auxiliary bag 10 can be removed by lifting it with handle 36 so that hook 34 disengages eye 37. The golfer may then carry auxiliary bag 10 to the green where the various clubs contained inside auxiliary bag 10 can be used.

After such use, the auxiliary bag 10 can be returned to the main bag by inserting the lower boot portion 16A (FIG. 1) into the pocket 18 (FIG. 2) of the main bag 22. Since boot 16 is keyed to the pocket 18, auxiliary bag 10 will always be oriented in the correct direction with handle 36 pointing outwardly and with hook 34 oriented towards the eye 37. Once the auxiliary bag 10 is positioned in approximately the correct position, it is lowered to place hook 34 into eye 34. Overhanging portion 16B then abuts the rim of pocket 18.

When the golfer is finished, the buckles 46 and 62 (FIG. 9) may be undone. The bag is not yet ready for transport since hook 34 is not secure enough. Accordingly, buckle 46 is returned to its original position so that strap 56 can be inserted into buckle 46, thereby securing auxiliary bag 10 to main bag 22. The strap 56 provides a high degree of security from accidental removal. With the strap 56 in the transport configuration, the bag combination can be safely carried, even with handle 36.

Figure 10:
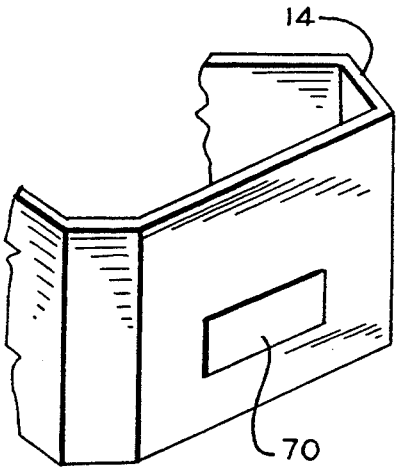
FIG. 10 is a detailed, axonometric view of the upper portion of the auxiliary bag of FIG. 1, with portions broken away for illustrative purposes, and modified to illustrate an alternate embodiment.
Figure 11:
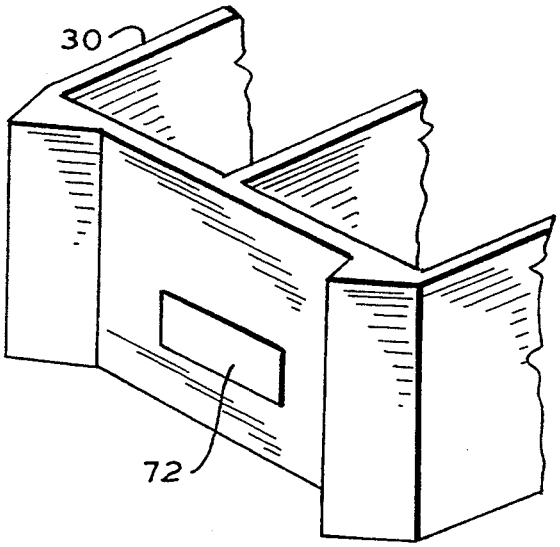
FIG. 11 is a detailed, axonometric view of the upper portion of the main bag of FIG. 2, with portions broken away for illustrative purposes, and modified to provide an alternate embodiment that cooperates with the embodiment of FIG. 10.

Referring to FIGS. 10 and 11, previously illustrated reinforcing collars 14 and 30 are shown without the hook and eye described above. Instead, the inside face of collar 14 is shown carrying a magnet 70. Reinforcing collar 30 is shown with a metal plate 72. In some embodiments, the magnet and plate can be reversed. Alternatively, a pair of magnets can be used instead. The magnet and plate (or magnet to magnet combination) is referred to as a complementary pair of magnetically attractive devices. Accordingly, collars 14 and 30 can be secured by the magnetic attraction between magnet 70 and metal plates 72. This arrangement allows the auxiliary bag to be removed without the lifting necessary when a hook is used.

Figure 12:
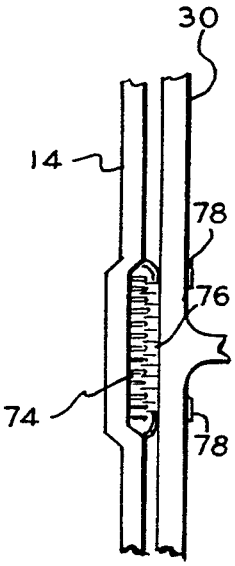
FIG. 12 is a detailed, top plan view of a holding means that is an alternate to that illustrated in FIG. 9.

Referring to FIG. 12, the previously mentioned magnets are replaced with a pair of Velcro pads 74 and 76. Pad 74 is mounted in a recess in reinforcing collar 14 by gluing, riveting or otherwise. Pad 76 is shown mounted on the face of reinforcing collar 30 by means of rivets 78, although in some embodiments pad 76 may be glued instead. Pads 74 and 76 will operate similarly to the previously mentioned magnet and metal plate and are referred to as a complimentary pair of adhering pads.

Figure 13:
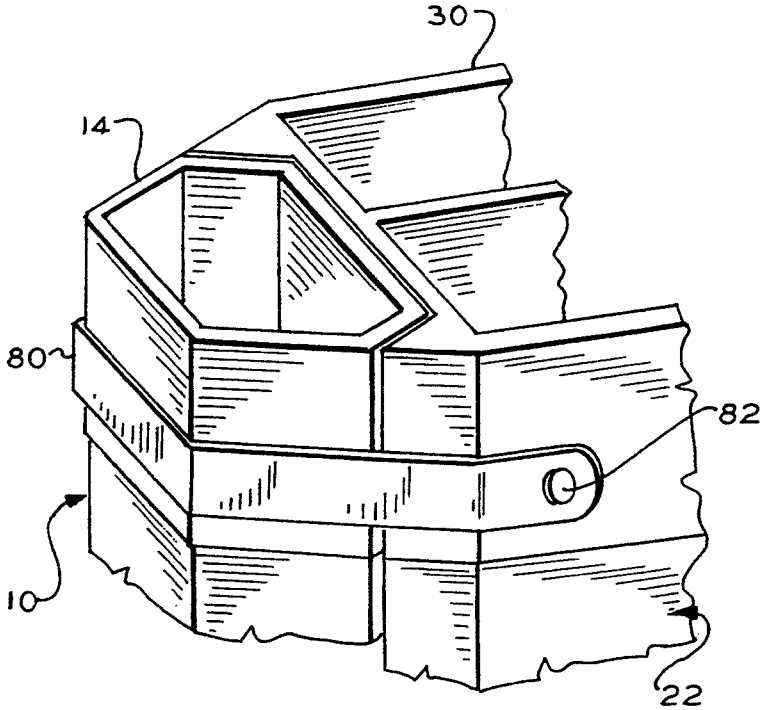
FIG. 13 is a detailed, axonometric view of an upper portion of the bag of FIG. 3, with portions broken away for illustrative purposes, and modified to illustrate an alternate embodiment.

Referring to FIG. 13, reinforcing collar 14 of auxiliary bag 10 is shown secured to collar 30 of main bag 22 by a strap 80. Strap 80 is shown having a snap 82 that attaches to an underlying stud (not shown) on reinforcing collar 30. The opposite end of strap 80 is riveted to the opposite side of reinforcing collar 30. Alternatively, snap 82 can be replaced with Velcro pads or other fastening means. Strap 80 may replace the previously illustrated holding means, i.e. the Velcro pads, the magnet and the hook. Alternatively, the strap 80 may work with those holding means and replace the previously illustrated transport strap (strap 56 of FIG. 3).

Referring to FIGS. 14, 15 and 16, the previously illustrated auxiliary bag 10 is shown outfitted with a U-shaped assembly 84. Assembly 84 has a cross member 86 connecting to a pair of legs 88. Assembly 84 is journalled to auxiliary bag 10 with trunions 90. Trunions 90 fit into matching grommet holes in the side of auxiliary bag 10. Legs 88 (as shown in FIG. 15) make an angle of about 120° with cross member 86. Cross member 86 acts as a stop to restrict the angular rotation of legs 88 to the approximate 90° degrees shown in FIG. 15. Because trunions 90 are not mounted on the widest portion of bag 10, legs 88 must spread outwardly to be deployed as shown in FIG. 16. This spreading increases the stability of the bag.

Thus by rotating the legs outwardly as shown in FIG. 15 (in full line) the bag 10 may be placed on the ground with the collar 14 raised to facilitate removal of clubs from the auxiliary bag 10.

It is to be appreciated that various modifications may be implemented with respect to the above described preferred embodiments. While the main and auxiliary bags are shown having the general shape of a polygonal prism, in other embodiments they may have curved perimeters including elliptical perimeters. Also, the bags may be attached by various means including elastic cords (bungee cords), and fasteners of various types such as those found in luggage, etc. Also, the main and auxiliary bags can have accessory pockets of various sizes for holding golf balls, gloves, clothing, etc. Also, the bags may have more handles, fewer handles or no handles at all. Moreover, the pocket for holding the bottom of the auxiliary bag need not have a shape exactly matching that of the auxiliary bag and need not be keyed. Furthermore, the auxiliary bag need not have an overhang to limit the extent to which the auxiliary bag descends into the pocket. Also, the various dimensions illustrated and the material used can be varied depending upon the number of clubs to be carried, and the desired physical strength, durability and weight of the bag. Also, while the auxiliary bag is shown smaller than the main bag, it need not be so.

Obviously many modifications and variations of the present invention are possible in light of the above teachings. It is therefore to be understood that within the scope of the appended claims, the invention may be practiced otherwise than as specifically described.

What is claimed is:

1. A golf bag comprising:

a main bag having an upper opening and being sized to hold golf clubs, said main bag having about a lower end of said main bag distal from said upper opening an upwardly open pocket, said open pocket being outside said main bag and spaced from said upper opening; and an auxiliary bag having an upper mouth and being sized to hold golf clubs, said auxiliary bag being sized to fit into said pocket, said pocket being directed to orient said auxiliary bag to lie alongside and outside said main bag.

2. A golf bag according to claim 1, comprising:

holding means for holding said auxiliary bag and said main bag together.

3. A golf bag according to claim 2, wherein said holding means comprises:

a hook detachably connecting said auxiliary bag and said main bag.

4. A golf bag according to claim 2, wherein said holding means comprises:

a complementary pair of adhering pads separately mounted on said auxiliary bag and said main bag for detachably holding them together.

5. A golf bag according to claim 2, wherein said holding means comprises:

a complementary pair of magnetically attractive devices separately mounted on said auxiliary bag and said main bag for detachably holding them together.

6. A golf bag according to claim 2, wherein said auxiliary bag is smaller than said main bag.

7. A golf bag according to claim 2, further comprising:

a securing means attached to said main bag for securing said auxiliary bag to said main bag.

8. A golf bag according to claim 2 wherein said main bag comprises:

a spaced pair of ribs extending longitudinally from opposite sides of said pocket along said main bag for forming a concavity for receiving said auxiliary bag.

9. A golf bag according to claim 2 comprising:

leg means pivotally mounted on said auxiliary bag for holding it at least partially erect.

10. A golf bag according to claim 2 comprising:

a U-shaped assembly having a pair of legs and a cross member connected to said pair of legs.

11. A golf bag according to claim 2, wherein said auxiliary bag has a lateral, upper recess, said holding means comprising:

a hook mounted in said upper recess of said auxiliary bag, said hook being adapted to detachable connect said auxiliary bag to said main bag.

12. A golf bag according to claim 11, wherein said holding means comprises:

an eye mounted on said main bag for receiving said hook.

13. A golf bag according to claim 2 wherein said auxiliary bag comprises:

a boot having a bottom portion keyed to fit inside said pocket with a predetermined orientation.

14. A golf bag according to claim 13 wherein said boot has an overhanging portion shaped to abut said pocket and prevent complete insertion of said boot into said pocket.

15. A golf bag according to claim 1, further comprising:

a securing means attached to said main bag for securing said auxiliary bag to said main bag.

16. A golf bag according to claim 15 wherein said securing means comprises:

a strap mounted on said main bag for embracing said auxiliary bag.

17. A golf bag according to claim 16 wherein said strap comprises:

a snap adapted to snap onto said main bag to secure said auxiliary bag.

18. A golf bag according to claim 16 wherein said securing means comprises:

a main buckle mounted on said main bag, said strap and said main buckle being mounted on opposites sides of an auxiliary region on said main bag for receiving said auxiliary bag.

19. A golf bag according to claim 18 wherein said golf bag is adapted to be mounted on a golf cart having a bag belt, said buckle being adapted to swing and receive either said strap or said belt.

20. A golf bag according to claim 18 wherein said golf bag is adapted to be mounted on a golf cart having a bag belt and a bag buckle, said strap being sized to reach said bag buckle when said auxiliary region faces away from said golf cart.

21. A golf bag according to claim 20 wherein said main buckle is adapted to swing and receive either said strap or said belt.

22. A golf bag according to claim 20 wherein said strap and said main buckle are detachably mounted on opposites sides of said auxiliary region to permit positional exchange, so that said strap and said main buckle can accommodate a golf cart having said bag belt and said bag buckle in transposed positions.

23. A golf bag according to claim 1 wherein said main bag comprises:

a main sleeve; and a base having a main receptacle for receiving said main sleeve and an auxiliary receptacle for receiving said auxiliary bag, said auxiliary receptacle forming at least part of said pocket.

24. A golf bag according to claim 23 wherein said main receptacle has a main rim, said auxiliary receptacle having an auxiliary rim portion whose height is lower than said main receptacle.

* * * * *